US009724583B2

(12) United States Patent
Van Dyke

(10) Patent No.: US 9,724,583 B2
(45) Date of Patent: Aug. 8, 2017

(54) BOWLING AIMING APPARATUS

(71) Applicant: Douglas Van Dyke, Fishers, IN (US)

(72) Inventor: Douglas Van Dyke, Fishers, IN (US)

( * ) Notice: Subject to any disclaimer, the term of this patent is extended or adjusted under 35 U.S.C. 154(b) by 77 days.

(21) Appl. No.: 14/493,754

(22) Filed: Sep. 23, 2014

(65) Prior Publication Data

US 2016/0082339 A1 Mar. 24, 2016

(51) Int. Cl.

| | |
|---|---|
| ***A63D 5/04*** | (2006.01) |
| ***F41J 1/10*** | (2006.01) |
| ***A63B 63/00*** | (2006.01) |
| ***A63B 69/00*** | (2006.01) |
| ***A63D 5/00*** | (2006.01) |

(52) U.S. Cl.

CPC ..... *A63B 69/0046* (2013.01); *A63B 63/00* (2013.01); *A63D 5/00* (2013.01); *A63B 2210/52* (2013.01); *A63B 2243/0054* (2013.01)

(58) Field of Classification Search

CPC ..... F41J 1/10; A63B 63/00; A63D 5/04
USPC ..... 473/54, 58; 273/270, 348, 390, 407
See application file for complete search history.

(56) References Cited

U.S. PATENT DOCUMENTS

| | | | | |
|---|---|---|---|---|
| 2,998,660 | A | 9/1961 | Hickey | |
| 3,094,330 | A | 6/1963 | Smith | |
| 3,105,685 | A | 10/1963 | Jahn | |
| 3,210,079 | A | 10/1965 | Tryon | |
| 3,317,208 | A | 5/1967 | Birkic | |
| 3,627,320 | A * | 12/1971 | Dopieralski | 473/54 |
| 4,397,432 | A * | 8/1983 | Resetar | 244/118.6 |
| 4,597,575 | A * | 7/1986 | Kosof | 473/54 |
| 4,787,633 | A * | 11/1988 | Fritzemeier | 473/54 |
| 4,787,634 | A * | 11/1988 | Gautraud | 473/54 |
| 4,789,157 | A * | 12/1988 | Gautraud | 473/54 |
| 4,817,947 | A * | 4/1989 | Gautraud | 473/54 |
| 4,834,378 | A * | 5/1989 | Brim | 473/54 |
| 4,834,379 | A * | 5/1989 | Brim | 473/54 |
| 4,834,380 | A * | 5/1989 | Brim | 473/54 |
| 4,834,381 | A * | 5/1989 | Brim | 473/54 |
| 4,884,806 | A * | 12/1989 | Brim | 473/54 |
| 4,930,775 | A * | 6/1990 | Hoffman | 473/54 |
| 5,074,422 | A * | 12/1991 | Holtz | 211/187 |
| 5,288,275 | A * | 2/1994 | St. Peter | 473/58 |
| 5,413,533 | A * | 5/1995 | Bolus et al. | 473/55 |
| 5,437,575 | A * | 8/1995 | Douglass, Jr. | 473/54 |
| 5,577,971 | A * | 11/1996 | File | 473/54 |
| 5,582,549 | A * | 12/1996 | File | 473/54 |

(Continued)

*Primary Examiner* — William Pierce
(74) *Attorney, Agent, or Firm* — Maginot, Moore & Beck, LLP

(57) ABSTRACT

A bowling aiming apparatus, configured to be used with a bowling lane, includes a frame and a target suspended from the frame. The frame includes two legs which lie parallel to one another within opposite troughs of the bowling lane and extend along a longitudinal direction of the troughs. The frame further includes two uprights, each coupled to a respective leg, such that the uprights are parallel to one another and perpendicular to the legs. The frame further includes a crossbar assembly coupled to the uprights and arranged perpendicularly to the uprights and perpendicularly to the legs. The crossbar assembly spans a width of the bowling lane. The target is suspended from the crossbar assembly, and is positioned on the crossbar assembly such that at least a portion of the target is arranged in a line of sight of a bowler using the bowling lane.

9 Claims, 3 Drawing Sheets

(56) References Cited

U.S. PATENT DOCUMENTS

| | | | | |
|---|---|---|---|---|
| 5,899,815 | A * | 5/1999 | Helou et al. | 473/54 |
| 6,017,278 | A * | 1/2000 | Benko | 473/70 |
| 6,059,126 | A * | 5/2000 | Miller | 211/85.15 |
| 6,267,064 | B1 * | 7/2001 | Ostertag et al. | 108/50.02 |
| 6,325,725 | B1 * | 12/2001 | Tsujita | 473/70 |
| 7,850,551 | B2 | 12/2010 | Barber | |
| 2001/0001199 | A1 * | 5/2001 | Sabounjian | 211/202 |
| 2002/0084588 | A1 * | 7/2002 | Lynch | 273/343 |
| 2008/0272548 | A1 * | 11/2008 | Hensley | 273/406 |
| 2011/0192811 | A1 * | 8/2011 | Sabounjian | 211/85.3 |
| 2013/0001880 | A1 * | 1/2013 | Dean et al. | 273/407 |
| 2014/0232067 | A1 * | 8/2014 | Barry | 273/392 |

* cited by examiner

BOWLING AIMING APPARATUS

BACKGROUND

Proper form and aim are important aspects of bowling. Those who desire to improve their bowling skills can practice proper form and aim with a coach or alone. It can be cost-prohibitive for some to practice bowling form and aim with a coach, so a desirable alternative may be to use an apparatus which can help improve form and body positioning. Additionally, such an apparatus can be a useful tool for a coach to use to assist a bowler in improving form and aim.

The "finishing form" or a "release position" is the bodily position of a bowler upon release of the bowling ball down the bowling lane. If the finishing form of the bowler is proper, then the released ball will roll down the bowling lane in the desired manner. Accordingly, by focusing on form, one can also improve aim. Proper finishing form includes a specific bodily position of the head, shoulders, back, hips, knees, feet, arms, elbows, and hands. It can be difficult for a bowler to focus on the position of each of these body parts at the same time. Accordingly, it is useful for a coach or an apparatus to draw attention to one particular body part at a time.

The position of the bowler's head, in particular, is of great importance to finishing form. If the bowler's head is angled when the ball is released, the bowler is likely to release the ball at the same angle. In other words, the bowling ball will follow where the head is pointed in the release position. Additionally, it is important for the bowler's body to be bent and angled correctly throughout the approach and release of the bowling ball. One way to promote bending and angling the body correctly is by indicating a desired height of the bowler's head when the ball is released. Accordingly, it is useful for a coach or apparatus to draw attention to, and direct the bowler with respect to, the position and angle of the bowler's head in the release position.

The position of the bowler's feet is also important to finishing form. In particular, the alignment of the feet relative to the width of the bowling lane can impact the alignment of the ball within the lane once the ball is released. Accordingly, it is also useful for a coach or apparatus to draw attention to, and direct the bowler with respect to, the position and angle of the bowler's feet in the release position.

It is also important, however, that while the bowler is focusing on form and release position, that the bowler's view of the pins at the end of the lane is not obstructed. This enables the bowler to align the body with respect to the pins and to note what correct form and release position feels like when the eyes are aligned with a particular position down the bowling lane. With enough practice, the bowler's body should feel natural engaging in proper form and release position, thus improving aim.

SUMMARY

A bowling aiming apparatus is provided to help a bowler practice aim while bowling. The apparatus includes a frame and a target suspended from the frame. The frame includes legs, which are arranged within the troughs or gutters along the sides of a bowling lane. The frame also includes upright portions coupled to the legs so as to project upwardly from the troughs on either side of the bowling lane. The frame also includes a crossbar assembly coupled to the upright portions so as to span the bowling lane. The target is suspended from the crossbar assembly so as to be positioned in front of a bowler using the bowling lane. The target is able to be positioned anywhere along the crossbar assembly, and thus anywhere along the width of the bowling lane. Additionally, the target is adjustable to be suspended different distances from the crossbar assembly.

When in use, the frame is positioned so that the target is aligned above the foul line of the bowling lane, the position of the target is adjusted along the width of the bowling lane, and the distance of the target relative to the crossbar assembly is adjusted. The depth of the target may also be adjusted. The target is thereby positioned to indicate where a portion of the bowler's body should be located when releasing a bowling ball down the bowling lane.

The aiming apparatus disclosed herein allows the bowler to suspend multiple targets anywhere in a three-dimensional space in positions that will optimize his/her bowling skills. The three-dimensionally positioned target allows the bowler to achieve proper form, balance and timing during approach and delivery of the bowling ball down the lane.

DETAILED DESCRIPTION

Figure 1:
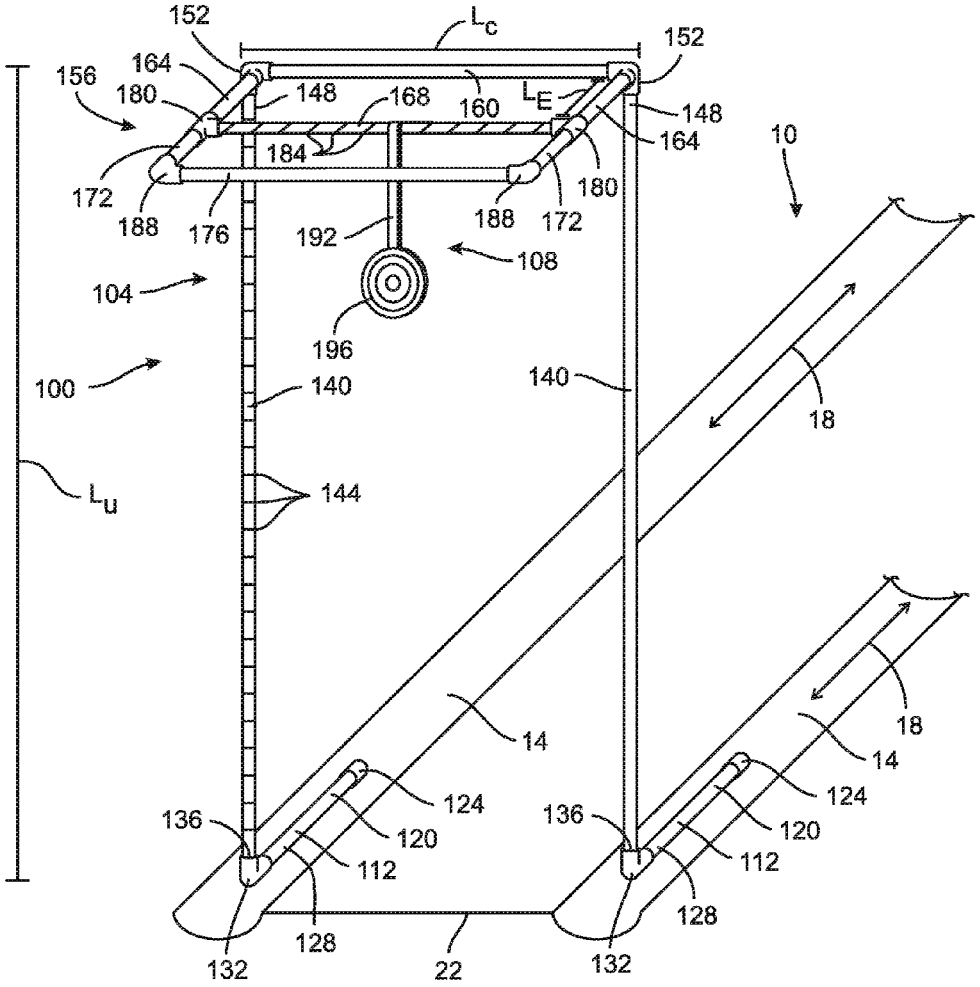
FIG. 1 depicts a perspective view of a bowling aiming apparatus in a typical use environment.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure encompasses any alterations and modifications to the illustrated embodiments and includes further applications of the principles of the disclosure as would normally occur to one skilled in the art to which this disclosure pertains.

FIG. 1 depicts a bowling aiming apparatus 100 to be used with a bowling lane 10 to assist a bowler in body positioning and aiming while bowling. The apparatus 100 includes a frame 104 and a target 108 suspended from the frame 104. As described in detail below, the position of the target 108 relative to the frame 104 is adjustable and is positioned to indicate where a part of the bowler's body should be located when releasing a bowling ball down the bowling lane 10. For example, the target 108 can be positioned to indicate where the bowler's head should be located or where the bowler's left foot should be located when releasing a bowling ball.

The frame 104 is made up of a plurality of pieces coupled together at joints. This arrangement is advantageous because it enables the frame 104 to be easily assembled and disassembled for compact storage. Additionally, the disassembled frame can be portable to and from a bowling alley. The frame 104 can be made of a lightweight, durable material such as, for example polyvinyl chloride (PVC) pipe. Pieces of the frame 104 can also be hollow and tubular, as in the case of PVC pipe, and include connectors, such as standard PVC fittings or couplings, configured to receive pieces of the frame 104 therein. In alternative embodiments, the frame 104 can be made of another lightweight, durable material and pieces of the frame can be coupled together in any manner which releasably fixes the pieces relative to one another. The frame elements may also be of telescoping construction.

The frame 104 includes two identical legs 112, each of which is configured as a straight, elongated member configured to rest in a trough or gutter 14 of the bowling lane 10 and extend along a longitudinal direction 18 of the trough or gutter 14. In at least one embodiment, the legs 112 can be held in place within the troughs 14 by placing a bowling ball on top of the legs 112. Alternatively, the legs 112 can be weighted down in another manner or can include weights disposed within the legs to retain the legs 112 in the desired positions in the troughs 14. Each of the legs 112 can include an end cap 124 coupled to a first end 120 to keep unwanted debris and material from entering the first end 120 of the leg 112, if the legs 112 are hollow, and to provide the legs 112 with a finished aesthetic.

At a second end 128, opposite the first end 124, each leg 112 is coupled to a leg-upright connector 132. Each leg-upright connector 132 is configured to receive the second end 128 of a respective leg 112 and receive a lower end 136 of a respective upright 140. The leg-upright connectors 132 are "L" shaped, like 90° elbow fittings for PVC pipe. Accordingly, when received in the leg-upright connector 132, a leg 112 is positioned perpendicularly relative to a respective upright 140. Thus, when the leg 112 is placed in the trough 14 of the bowling lane 10, the upright 140 projects upwardly from the trough 14.

Each upright 140 has a length $L_U$ which projects upwardly from the trough 14. The length $L_U$ can be, for example, between approximately six feet and approximately six feet, six inches. In at least one embodiment, at least one of the uprights 140 can also include height markings 144 along the length $L_U$ of the upright 140. The height markings 144 indicate a height of a location of the target 108. In at least one embodiment, the height markings 144 can be provided on a sticker which is affixed to the upright 140. Each upright 140 also has an upper end 148, opposite the lower end 136, configured to be coupled to a respective upright-crossbar connector 152.

Each upright-crossbar connector 152 is configured to receive the upper end 148 of a respective upright 140 and receive an end of a crossbar 160 of a crossbar assembly 156. Each of the upright-crossbar connectors 152 is shaped as a three-way connector, like a three-way elbow fitting for a PVC pipe. The upright-crossbar connectors 152 are arranged such that, when received in an upright-crossbar connector 152, an upright 140 is positioned perpendicularly relative to the crossbar 160. Accordingly, when assembled as shown in FIG. 1, the crossbar 160 is arranged perpendicularly relative to the uprights 140 and perpendicularly relative to the legs 112.

The crossbar assembly 156 includes the crossbar 160 as well as extensions 164, a suspension bar 168, further extensions 172, and a third bar 176. The extensions 164 are also coupled to the upright-crossbar connectors 152 such that the extensions 164 are arranged perpendicularly relative to the uprights 140, perpendicularly relative to the crossbar 160, and parallel to the legs 112. Accordingly, the extensions 164 are aligned in the longitudinal direction 18 of the troughs 14. However, the extensions 164 project in an opposite direction than the legs 112. When the apparatus 100 is in use, the legs 112 project in a direction away from the bowler and the extensions 164 project in a parallel and opposite direction toward the bowler. The extensions 164 have a length $L_E$ which projects forwardly from the crossbar 160. The length $L_E$ can be, for example twelve inches.

The crossbar 160 has a length $L_C$ which extends between the upright-crossbar connectors 152. Accordingly, the uprights 140 and the legs 112 are also separated by the length $L_C$. The crossbar 160 is configured to span the width of the bowling lane 10, and the legs 112 are to be positioned within the troughs 14 on either side of the bowling lane 10. Preferably, each leg 112 is positioned approximately in the center of a respective trough 14. Thus, the length $L_C$ of the crossbar 160 is as long as the width of the bowling lane 10 plus one half of the width of each of the troughs 14. In other words, the length $L_C$ of the crossbar 160 is as long as the width of the bowling lane 10 plus the width of one trough 14. For use with a standard bowling lane, the length $L_C$ of the crossbar 160 is approximately 50.75 inches.

The extensions 164 are also coupled to extension-suspension bar connectors 180 at ends opposite the upright-crossbar connectors 152. The extension-suspension bar connectors 180 are "T" shaped, like a three-way tee fitting for PVC pipe. Each of the extension-suspension bar connectors 180 is arranged to receive an end of an extension 164, an end of the suspension bar 168, and an end of a further extension 172 such that the extensions 164 and the further extension 172 are arranged coaxially with each other on opposite sides of the extension-suspension bar connector 180, and the suspension bar 168 is arranged perpendicularly relative to the extension 164 and the further extension 172.

The suspension bar 168 is also arranged to be parallel to the crossbar 160. Because the suspension bar 168 is separated from the crossbar 160 by the extensions 164, the suspension bar 168 is spaced apart from the crossbar 160 by the length $L_E$. The suspension bar 168 is also configured to span the bowling lane 10, and the suspension bar 168 is of the same length $L_C$ as the crossbar 160. The suspension bar 168 includes a plurality of width markings 184 along the length of the suspension bar 168. When the apparatus 100 is assembled and installed in the bowling lane 10 as shown in FIG. 1, the width markings 184 align with standard dots and arrows (not shown) which mark a standard bowling lane 10 to indicate lane alignment along the length of the bowling lane 10. In at least one embodiment, the width markings 184 can be provided on a sticker which is applied to the suspension bar 168.

The further extensions 172 are substantially similar to the extensions 164 and the third bar 176 is substantially similar to the crossbar 160. The further extensions 172 can have a length that is shorter than the length $L_E$ of the extensions 164. The third bar 176 is provided to increase structural stability of the crossbar assembly 156 of the frame 104 and to balance the weight of the top of the frame 104 relative to the bottom of the frame 104. Each of the further extensions 172 is coupled to a respective extension-suspension bar connector 180 at one end and to a respective extension-third bar connector 188 at an opposite end. The extension-third bar connectors 188 are "L" shaped, like 90° elbow fittings for PVC pipe. The third bar 176 is received in each of the extension-third bar connectors 188 such that the third bar 176 is arranged perpendicularly relative to the further extensions 172 and parallel to the suspension bar 168 and the crossbar 160.

In an alternative embodiment, the extensions 164 and the further extensions 172 can be formed together such that an extension 164 and respective further extension 172 is a single extension piece. In this embodiment, each of the single extension pieces is received in a respective upright crossbar connector 152 and in a respective extension-third bar connector 188. Each of the extension-suspension bar connectors 180 are slidingly placed on a respective single extension piece at a position between the crossbar 160 and the third bar 176.

In another alternative embodiment, the crossbar assembly 156 does not include further extensions 172 or a third bar 176. In this embodiment, the crossbar assembly 156 only includes the crossbar 160, extensions 164, and suspension bar 168 coupled together by the upright-crossbar connectors 152 and the extension-suspension bar connectors 180. The extension-suspension bar connectors 180 are "L" shaped, like 90° elbow fittings for PVC pipe, to couple the extensions 164 to the suspension bar 168 in a perpendicular arrangement. This embodiment is advantageous in that the frame 104 includes fewer parts, and is therefore easier to assemble and disassemble, and the resulting apparatus 100 has a lighter weight.

In another embodiment, the cross-bar 168 is configured to be adjustably mounted to the extensions 164. In this embodiment, the connectors 180 may be slidably mounted on the extensions so that the depth of the cross-bar can be adjusted.

The target 108 includes a strap 192 and a visual reference 196, which may be a bullseye or other highly visible marking. For the purposes of the present disclosure, the visual reference 196 will be assumed to be a bullseye. The strap 192 is configured to be coupled to the suspension bar 168 and to the bullseye 196 such that the bullseye 196 is suspended from the suspension bar 168. The strap 192 can be made of a hook and loop material which engages with itself to attach the strap 192 around the suspension bar 168. Alternatively, the strap 192 can be a string which is tied to itself to attach the strap 192 around the suspension bar 168. The strap 192 is positioned along the length of the suspension bar 168 by using the width markings 184. The bullseye 196 is therefore suspended from the suspension bar 168 at a location relative to the width markings 184 provided on the suspension bar 168. The bullseye 196 can be a traditional concentric circle pattern, or alternatively, the bullseye 196 can have any desired pattern visible to the bowler. The bullseye 196 can also include a weight (not shown) which is heavy enough so that the bullseye 196 hangs substantially straight downwardly from the suspension bar 168.

The height of the bullseye 196 is set by lengthening or shortening the strap 192 on the suspension bar 168. To place the bullseye 196 at a higher position relative to the frame 104, the strap is shortened. Conversely, to place the bullseye 196 at a lower position relative to the frame 104, the strap is lengthened. The bullseye 196 can be suspended from the suspension bar 168 at a location relative to the height markings 144 provided on the upright 140. Thus, using the width markings 184 on the suspension bar 168 in conjunction with the height markings 144 on the upright 140, the bullseye 196 can be positioned at a particular location relative to the frame 104.

The depth of the target 108 can also be adjusted by positioning the target on any of the horizontal bars 160, 168 or 176. In certain embodiments, the bar 168 may be adjustable in the horizontal plane to permit easy adjustment of the depth of a target mounted to the bar.

To use the apparatus 100, the frame 104 is assembled as shown in FIG. 1, and is arranged such that the legs 112 are positioned in the troughs 14 on either side of the bowling lane 10. The frame 104 is then positioned such that the suspension bar 168 is positioned directly above a foul line 22 of the bowling lane 10. Once the frame 104 is arranged and positioned relative to the bowling lane 10, bowling balls are placed on the legs 112 to retain the frame 104 in this position. Next, the target 108 is affixed to the suspension bar 168. The bullseye 196 is positioned at a desired height and width location relative to the frame 104 such that the bullseye 196 is in a particular position in a line of view of the bowler relative to the bowling lane 10. The bullseye 196 can be positioned to indicate where the bowler's forehead should be when the bowler releases a bowling ball down the bowling lane 10. Alternatively, the bullseye 196 can be positioned to indicate where a bowler's foot should be when the bowler releases a bowling ball down the bowling lane 10. Once the bullseye 196 is positioned, the strap 192 is affixed to the suspension bar 168 to retain the bullseye 196 in this position, and the apparatus 100 is ready to be used.

In use, the bowler approaches the apparatus 100 while keeping the gaze directed down the bowling lane 10 toward pins (not shown). The target 108 does not substantially obstruct the bowler's view of the lane 10 or the pins. As the bowler releases the bowling ball down the lane 10, the bowler attempts to align the intended body part with the bullseye 196. For example, the bullseye 196 can be positioned to indicate where the bowler's forehead should be when the bowler releases the bowling ball. Accordingly, when releasing the bowling ball, the bowler attempts to align the forehead with the bullseye 196, which is in the bowler's line of sight, but does not obstruct the bowler's view of the lane 10 and pins. When the bullseye 196 is positioned to indicate where the bowler's foot should be when releasing the bowling ball, the strap 192 is in the bowler's line of sight, indicating desired alignment, but does not obstruct the bowler's view of the lane 10 and pins. After releasing the ball, the bowler can look downwardly to determine whether the foot is located at the bullseye 196. Another advantage of this arrangement is that the bullseye 196 is aligned approximately with the foul line 22. Thus, when the bowler approaches and releases the bowling ball, the bowler will know if a portion of the body has crossed the foul line 22 if that portion contacts the bullseye 196.

In an alternative embodiment, the apparatus 100 can include more than one target 108 configured to be suspended simultaneously from the suspension bar 168. Each of the targets 108 can be independently positioned to indicate the desired location of a body part of the bowler when releasing the ball. For example, the apparatus 100 can simultaneously indicate the desired position of the bowler's head and foot when releasing the ball.

Figure 2:
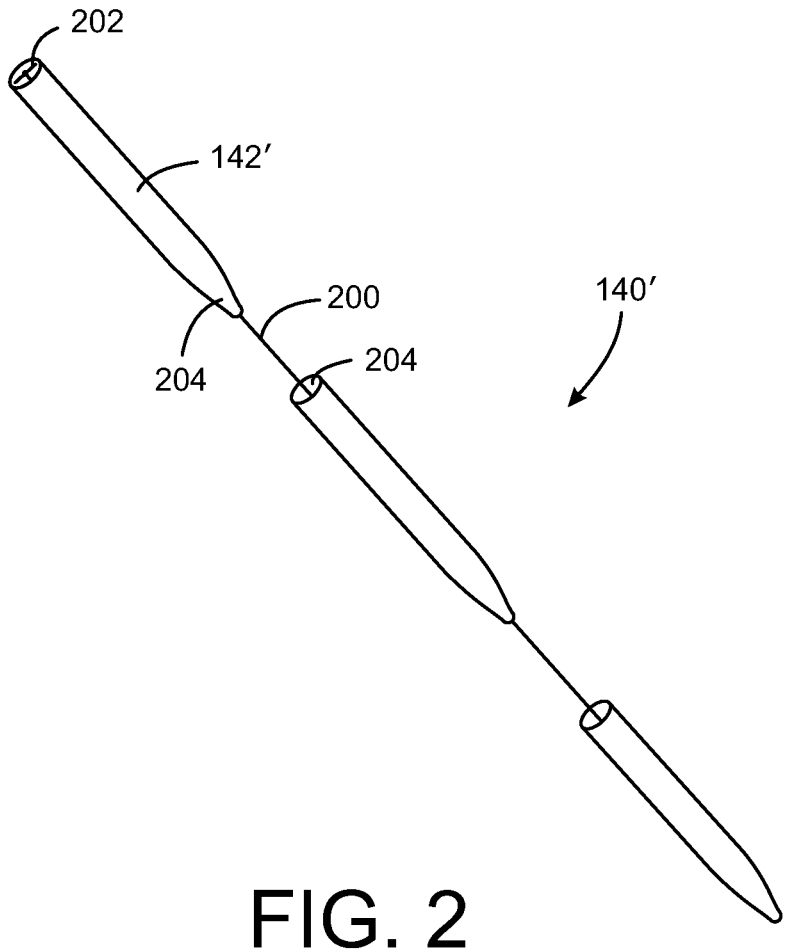
FIG. 2 depicts a portion of an alternative embodiment of a bowling aiming apparatus which includes an elastic cord for storage and assembly.

In an alternative embodiment, portions of the frame 104 can include elastic cords 200 and coupling portions 204, as shown in the upright 140' shown in FIG. 2. In this embodiment, the upright 140' is made up of a plurality of hollow tubes 142', like PVC pipe, for example. Each of the hollow tubes 142' can have the same length, or, alternatively, each of the hollow tubes 142' can have a different length. The elastic cord 200 is received through and retained within the hollow tubes 142' such that all of the hollow tubes 142' are movably retained on the elastic cord 200. To retain the elastic cord 200, the hollow tubes 142' which form the ends of the upright 140' can include a cross member 202 to which the elastic cord 200 is tied.

Each of the hollow tubes 142' includes coupling portions 204 at both ends such that the hollow tubes 142' can be fitted together. The elastic cord 200 provides a compressive force which holds the hollow tubes 142' together when the coupling portions 204 are matingly coupled together. In this embodiment, when the frame 104 is disassembled, the coupling portions 204 on the ends of the hollow tubes 142' of the upright 140' can be separated from one another while all of the hollow tubes 142' are retained on the elastic cord 200. One advantage of this embodiment is that the upright 140' can be folded down into a smaller size. The frame 104 can then be stored or carried more easily as the largest part of the frame 104 is the largest hollow tube 142'. Another advantage of this embodiment is that the frame 104 is easier to assemble because parts that fit together are retained in a relative order on the elastic cord 200. Another advantage of this embodiment is that there is a smaller chance of losing parts of the frame 104 because they are retained together on the elastic cord 200. In other embodiments, the arrangement of the hollow tubes 142' of the upright 140' can also be applied to the legs 112, and the crossbar assembly 156.

Figure 3:
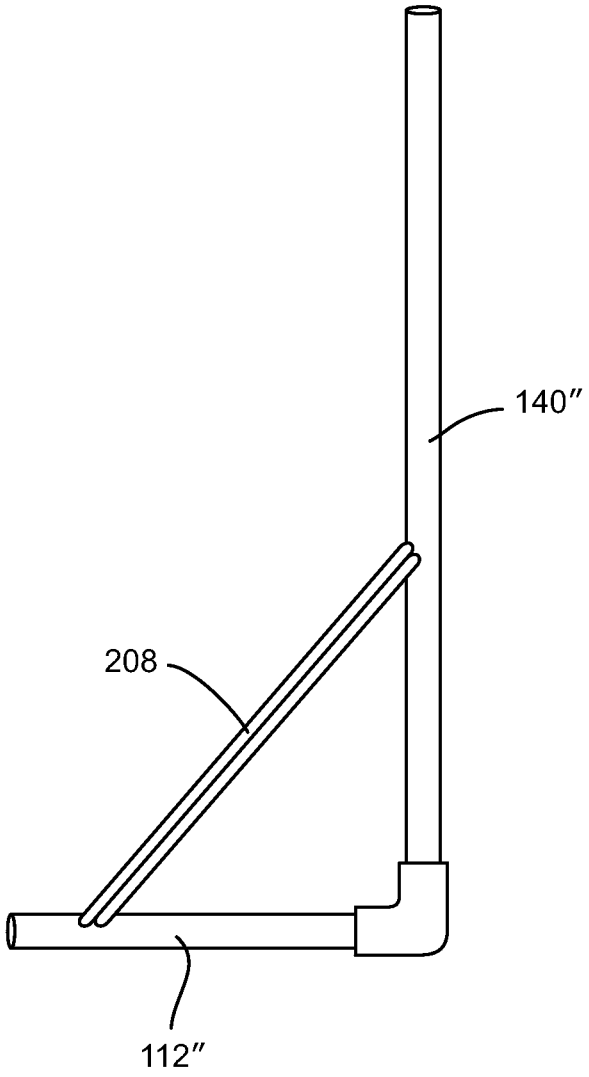
FIG. 3 depicts a portion of another alternative embodiment of a bowling aiming apparatus which includes additional support members.

In another alternative embodiment, the frame 104 can include support straps 208 coupled to the uprights 140" and the legs 112" as shown in FIG. 3. The support straps 208 can be coupled to the frame 104 after the apparatus 100 is assembled as shown in FIG. 1 to provide additional structural stability and integrity to the frame 104. The support straps 208 can be coupled to the uprights 140" and the legs 112" in any manner which is secure and non-destructively removable. The support straps 208 can be, for example, nylon straps which are inserted through holes in the uprights 140" and the legs 112". Alternatively, the support straps 208 can be formed from any material which can provide flexible support to the legs 112" and the uprights 140". The support straps 208 help retain the positions of a leg 112" relative to a respective upright 140" by preventing rotation of the upright 140" relative to the leg 112". This is especially useful for longer uprights, which may tend to rotate or twist due to the weight of the crossbar assembly 156 which is positioned far from the legs 112. One advantage of this embodiment is the additional structural stability for very little added weight to the apparatus 100. Additionally, this stability requires little additional effort to assemble.

While the invention has been illustrated and described in detail in the drawings and foregoing description, the same should be considered as illustrative and not restrictive in character. It is understood that only the preferred embodiments have been presented and that all changes, modifications, and further applications that come within the spirit of the invention are desired to be protected.

What is claimed is:

1. A bowling aiming apparatus for use by a bowler using a bowling lane, the bowling lane defining a width and having a trough on each of two opposite sides of the width, the troughs defining a longitudinal direction, the bowling aiming apparatus comprising:

a first leg and a second leg configured to lie parallel to one another within each of the troughs of the bowling lane such that the first and second legs extend along a longitudinal direction of the troughs;

a first upright coupled to the first leg and a second upright coupled to the second leg such that the first and second uprights are parallel to one another and perpendicular to the first and second legs;

a crossbar assembly coupled to the first and second uprights and arranged perpendicularly to the first and second uprights and perpendicularly to the first and second legs, the crossbar assembly configured to span the width of the bowling lane; and a target affixed to the crossbar assembly at a predetermined location, the target configured to be positioned on the crossbar assembly such that at least a portion of the target is arranged along a line of sight of the bowler, wherein the crossbar assembly includes:

a crossbar coupled to the first and second uprights;

a first extension coupled to the crossbar adjacent the first upright and a second extension coupled to the crossbar adjacent the second upright such that the first and second extensions are parallel to one another and parallel to the first and second legs; and a suspension bar coupled to the first and second extensions such that the suspension bar is parallel to the crossbar.

2. The bowling aiming apparatus of claim 1, wherein the first upright is coupled to an end of the first leg and the second upright is coupled to an end of the second leg.

3. The bowling aiming apparatus of claim 1, wherein:

the first and second legs project from the uprights in a first direction; and the first and second extensions project from the crossbar in a second direction opposite the first direction.

4. The bowling aiming apparatus of claim 1, wherein the target is affixed to the suspension bar.

5. The bowling aiming apparatus of claim 1, wherein the crossbar assembly further includes a third bar coupled to the first and second extensions such that the third bar is parallel to the suspension bar and to the crossbar.

6. The bowling aiming apparatus of claim 1, wherein:

each of the crossbar, the first extension, the second extension, and the suspension bar includes a hollow body; and an elastic cord is passed through each hollow body to retain the crossbar, the first extension, the second extension, and the suspension bar thereon.

7. The bowling aiming apparatus of claim 6, wherein each end of each of the crossbar, the first extension, the second extension, and the suspension bar includes a coupling configured to matingly couple with an adjacent end of an adjacent one of the crossbar, the first extension, the second extension, and the suspension bar.

8. The bowling aiming apparatus of claim 7, wherein the crossbar, the first extension, the second extension, and the suspension bar are configured to be arranged parallel to one another when the crossbar, the first extension, the second extension, and the suspension bar are not matingly coupled together.

9. The bowling aiming apparatus of claim 1, wherein:

the first leg includes a first plurality of hollow bodies and the second leg bar includes a second plurality of hollow bodies;

a first elastic cord is passed through each hollow body of the first plurality of hollow bodies to retain the first plurality of hollow bodies thereon; and a second elastic cord is passed through each hollow body of the second plurality of hollow bodies to retain the second plurality of hollow bodies thereon.

* * * * *